US006267624B1

(12) United States Patent
Wu et al.

(10) Patent No.: US 6,267,624 B1
(45) Date of Patent: Jul. 31, 2001

(54) ELECTRICAL CONNECTOR

(75) Inventors: Kun-Tsan Wu, Tu-Chen; Song-Rong Chiou, Lin-Kou, both of (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/337,974

(22) Filed: Jun. 22, 1999

(30) Foreign Application Priority Data

Dec. 11, 1998 (TW) ..... 87220688

(51) Int. Cl.[7] ..... H01R 13/648
(52) U.S. Cl. ..... 439/607; 439/608
(58) Field of Search ..... 439/101, 108, 439/608, 607, 609

(56) References Cited

U.S. PATENT DOCUMENTS 4,690,479 * 9/1987 Hollyday et al. ..... 439/97
4,842,529 * 6/1989 Frantz et al. ..... 439/95
5,052,948 * 10/1991 Hyzin ..... 439/607
5,921,814 * 7/1999 Maruyama ..... 439/607

* cited by examiner

*Primary Examiner*—Brian Sircus
*Assistant Examiner*—Thanh-Tam Le
(74) *Attorney, Agent, or Firm*—Wei Te Chung

(57) ABSTRACT

An electrical connector includes an insulative housing having a first face on which a tongue plate is formed. Passageways are defined in the housing and are further defined by grooves formed on surfaces of the tongue plate for receiving and retaining contact elements therein. A shroud wall having three sections and a guide wall are formed on the first face of the housing and define a space therebetween for receiving a mating connector. The guide wall and the shroud wall have diverging inside faces for guiding a mating connector into the space. A shielding member having three sections is received in the space and supported by the sections of the shroud wall. The shielding member has a lower edge received in a slot defined in the housing and an outwardly bent top edge for guiding the insertion of the mating connector into the space and electrically engages with the mating connector for electrostatic discharge purposes. A rib is formed on the shielding member for enhancing electrical engagement with the mating connector. Barbs are formed on the shielding member for engaging with recesses defined in the housing to secure the shielding member in position. A notch having inwardly extending barbs is defined in the shielding member for receivingly engaging with a projection formed on the housing for more securely retaining the shielding member in position.

13 Claims, 8 Drawing Sheets

ELECTRICAL CONNECTOR

BACKGROUND OF THE INVENTION

1. Field of the Invention

The present invention generally relates to an electrical connector.

2. The Prior Art

A plug connector inserted into a socket connector mounted on a circuit board to establish electrical connection therebetween is well known in the electronics field. Guiding means is usually provided between the plug and socket connectors for properly aligning with each other during insertion of the plug connector into the socket connector. Examples of a conventional plug connector are disclosed in U.S. Pat. No. 5,474,472 and Taiwan Patent Application No. 82203331. A conventional plug connector 6 is illustrated in FIG. 1 of the attached drawings, and comprises guiding posts 60 for being received in corresponding bores defined in the socket connector (not shown). A metal shell 61 encloses the plug connector 6 for electromagnetic interference (EMI) protection and electrostatic discharge (ESD) purposes.

However, correctly aligning the guiding posts 60 of the plug connector 6 with the bores of the socket connector is sometimes difficult. Furthermore, the manufacturing process of the plug connector 6 is complicated.

It is thus desirable to have an electrical connector that overcomes the problems mentioned above.

SUMMARY OF THE INVENTION

Accordingly, an object of the present invention is to provide an electrical connector having guiding means for mating the connector with a mating connector.

Another object of the present invention is to provide an electrical connector having a shielding member received in a receiving space thereof for electrically engaging with a grounding member of a mating connector to facilitate electrostatic discharge.

A further object of the present invention is to provide an electrical connector having a simplified manufacturing process.

To achieve the above objects, an electrical connector in accordance with the present invention comprises an insulative housing having a first face on which a tongue plate is formed. Passageways are defined in the housing and are further defined by grooves formed on surfaces of the tongue plate for receiving and retaining contact elements therein. A shroud wall having three sections and a guide wall are formed on the first face of the housing and define a space therebetween for receiving a mating connector. The guide wall and the shroud wall have diverging inside faces for guiding a mating connector into the space. A shielding member having three sections is received in the space and supported by the sections of the shroud wall. The shielding member has a lower edge received in a slot defined in the housing and an outwardly bent top edge for guiding the insertion of the mating connector into the space and electrically engaging with the mating connector for electrostatic discharge purposes. A rib is formed on the shielding member for enhancing electrical engagement with the mating connector. Barbs are formed on the shielding member for engaging with recesses defined in the housing to secure the shielding member in position. A notch having inwardly extending barbs is defined in the shielding member for receivingly engaging with a projection formed on the housing for more securely retaining the shielding member in position.

BRIEF DESCRIPTION OF THE DRAWINGS

The present invention will be apparent to those skilled in the art by reading the following description of a preferred embodiment thereof, with reference to the accompanying drawings, in which.

DETAILED DESCRIPTION OF THE PREFERRED EMBODIMENT

Figure 1:
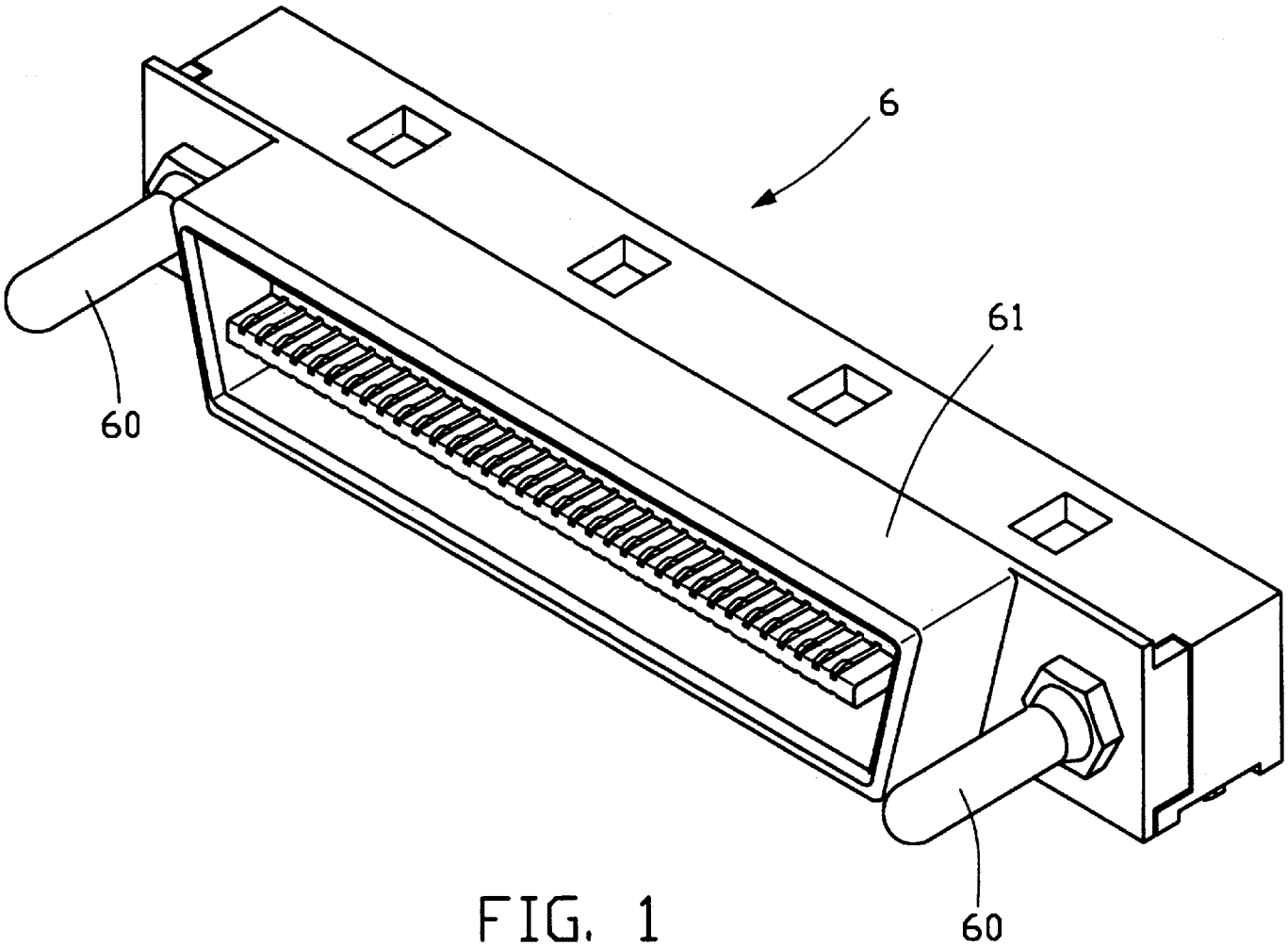
FIG. 1 (PRIOR ART)
FIG. 1 is a perspective view of a conventional plug connector.
Figure 2:
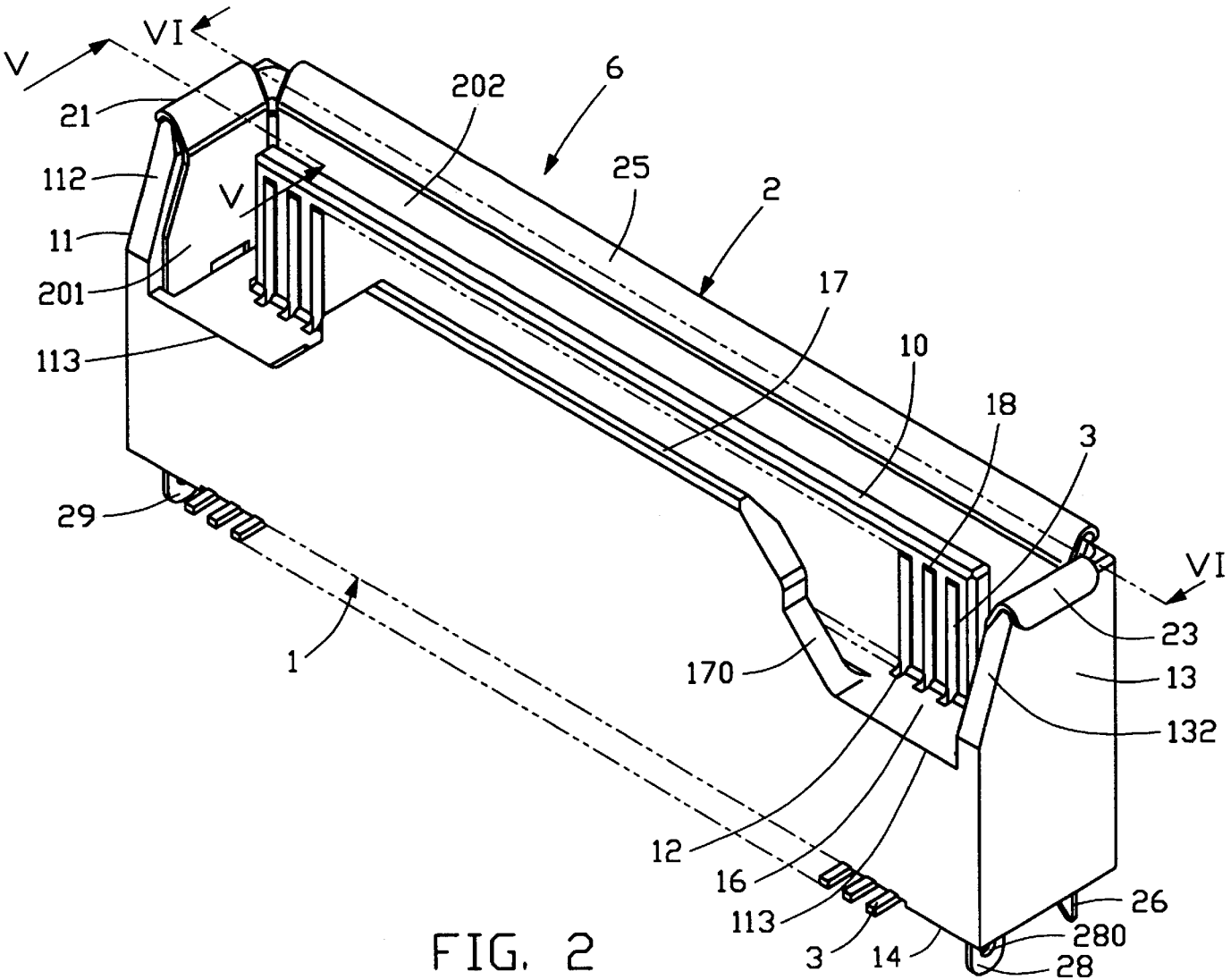
FIG. 2 is a perspective view of a plug connector constructed in accordance with the present invention.
Figure 3:
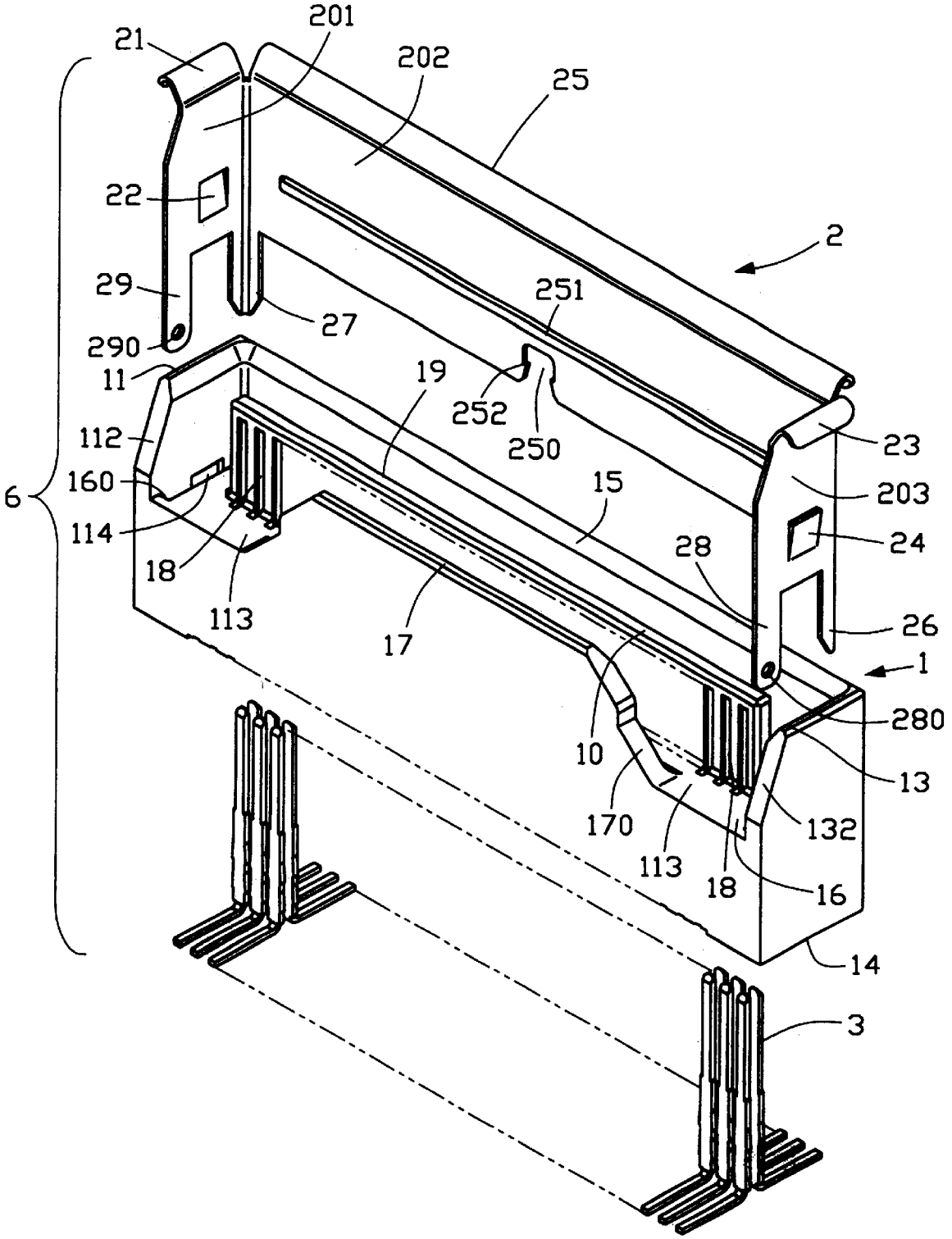
FIG. 3 is an exploded view of FIG. 2.

Referring to the drawings and in particular to FIGS. 2 and 3, a plug connector 6 constructed in accordance with the present invention comprises an insulative housing 1 having a first face 16 and an opposite second face 14. A tongue plate 10 is formed on the first face 16 of the housing 1. A plurality of passageways 12 are defined in the housing 1 between the faces 16, 14 for receiving contact elements 3 with opposite ends extending beyond the faces 16, 14. The passageways 12 are further defined by grooves 18 formed in opposite surfaces of the tongue plate 10 for accommodating the ends of the contact elements 3 extending beyond the first face 16.

Figure 7:
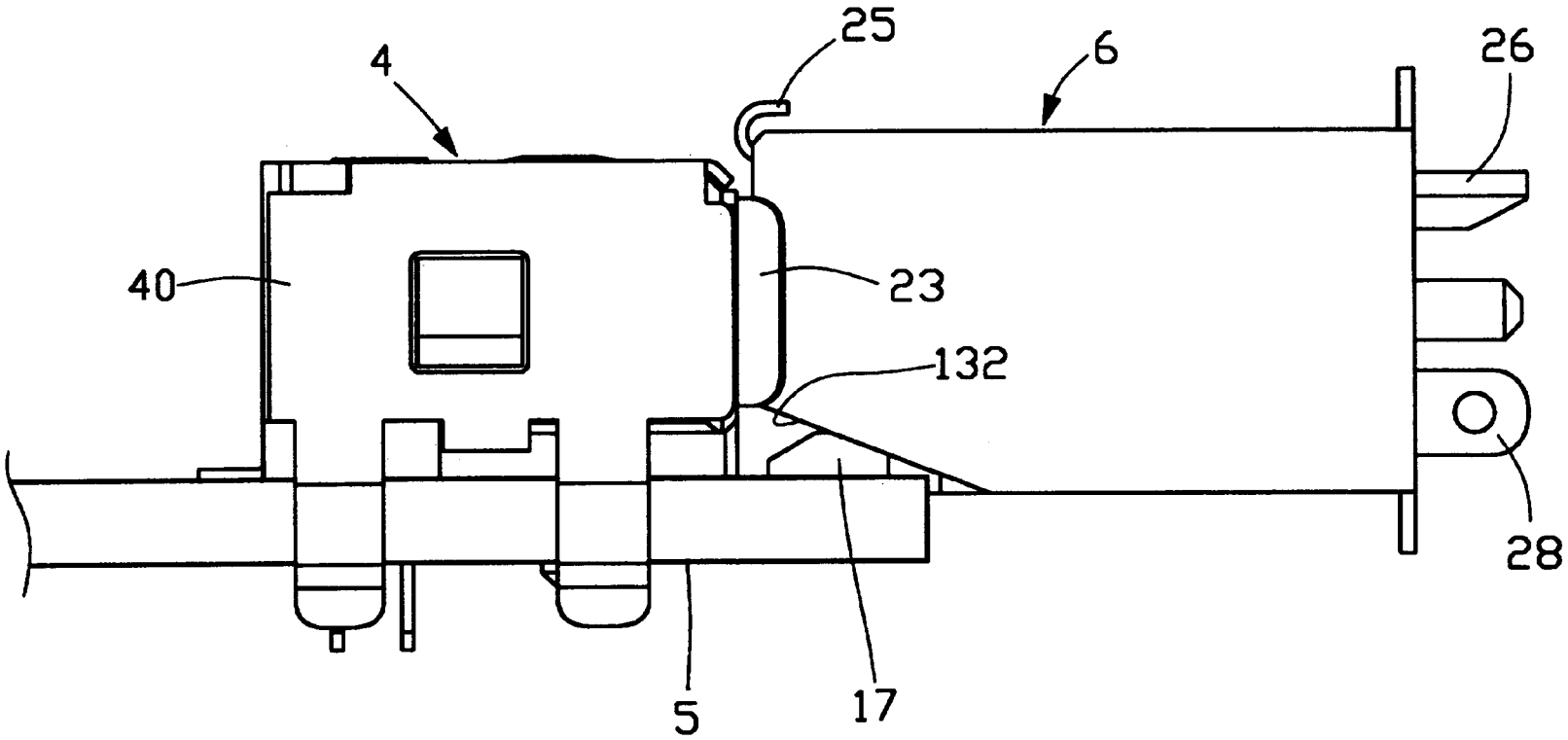
FIG. 7 is a side elevational view showing the plug connector mating with a socket connector mounted on a circuit board.
Figure 8:
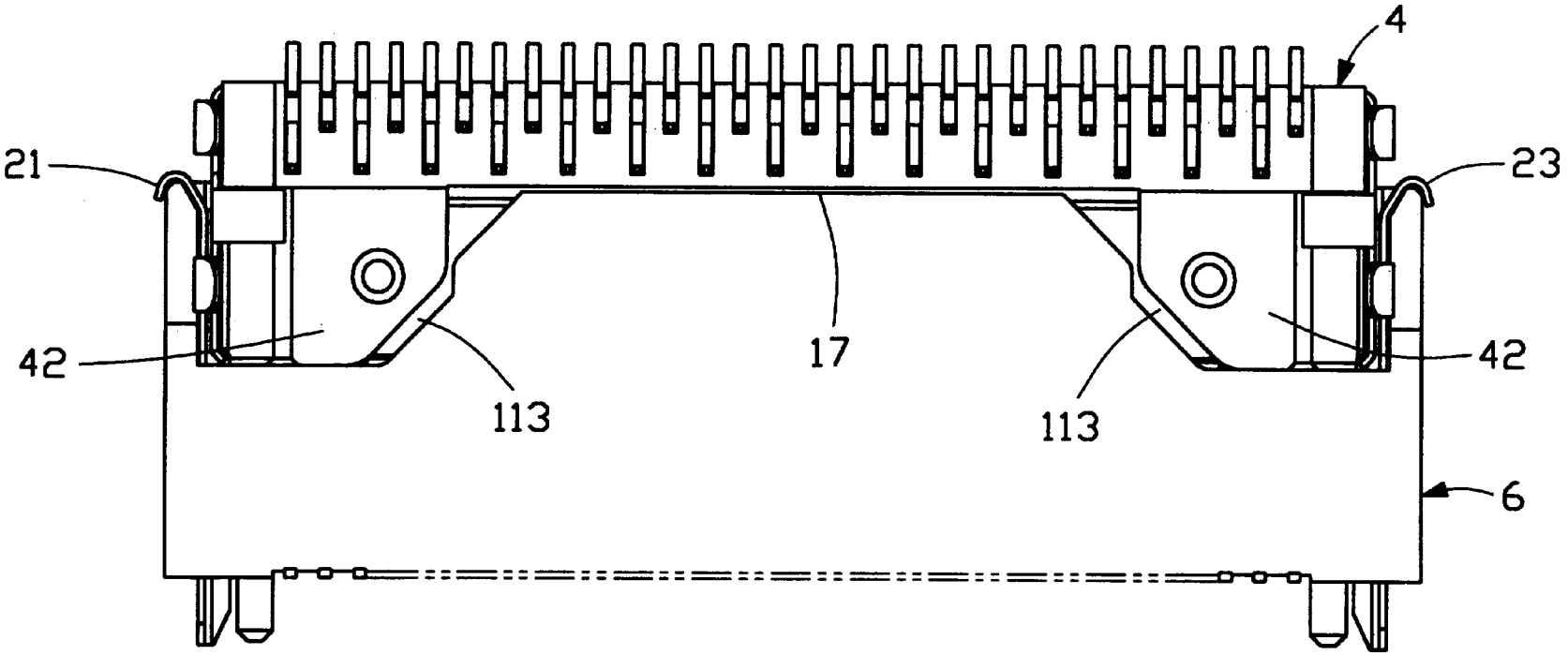
FIG. 8 is a bottom view of FIG. 7 with the circuit board removed.

A shroud wall comprising a longitudinal section 15 and a pair of lateral sections 11, 13 extending from opposite sides thereof is formed on the first face 16 of the housing 1 and partially surrounds the tongue plate 10. The sections 11, 13, 15 of the shroud wall are spaced from the tongue plate 10 thereby defining a space 19 therebetween for receiving a mating socket connector 4 (FIGS. 7 and 8). A guiding wall 17 is also formed on the first face 16 of the housing 1 and defines two notches 113 for receiving corresponding projection portions 42 of the socket connector 4. The space 19 is surrounded by the shroud wall and the guiding wall 17. The sections 11, 13, 15 of the shroud wall and the guiding wall 17 have inclined inside faces diverging from each other for guiding the insertion of the mating connector 4 into the space 19. The guiding wall 17 also has opposite inclined lateral edges 170 for guiding the mating connector 4 with respect to the connector 6.

Inclined edges 112, 132 are formed on the lateral sections 11, 13 of the shroud wall for guiding a relative movement between the plug connector 6 and a circuit board 5 on which the socket connector 4 is mounted (FIG. 7). During insertion of the plug connector 6 into the socket connector 4, the inclined faces 112, 132 of the lateral sections 11, 13 of the shroud wall serve as camming means for guiding the relative movement of circuit board 5 with respect to the connector 6 thereby preventing the plug connector 6 from directly impacting and damaging the circuit board 5.

Figure 4:
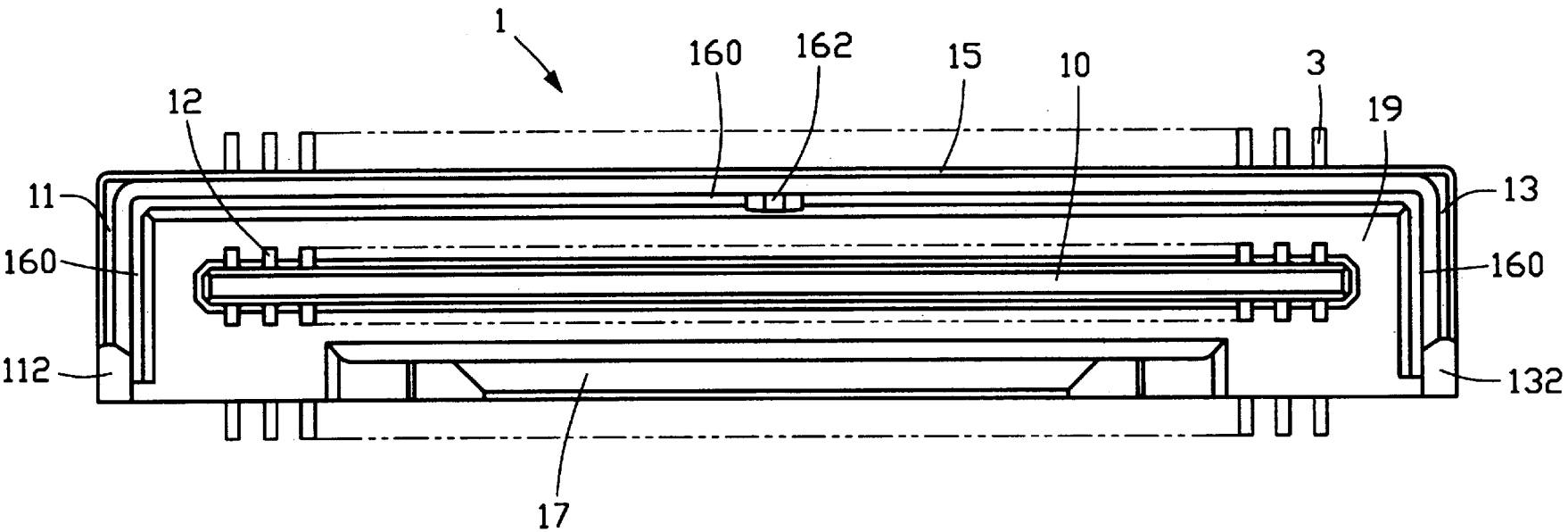
FIG. 4 is a top FIG. 2 with a shielding member removed.

A shielding member 2 is received in the space 19 of the housing 1 with a lower edge thereof inserted into a slot 160 (FIGS. 3 and 4) defined in the first face 16 of the housing 1.

Figure 6:
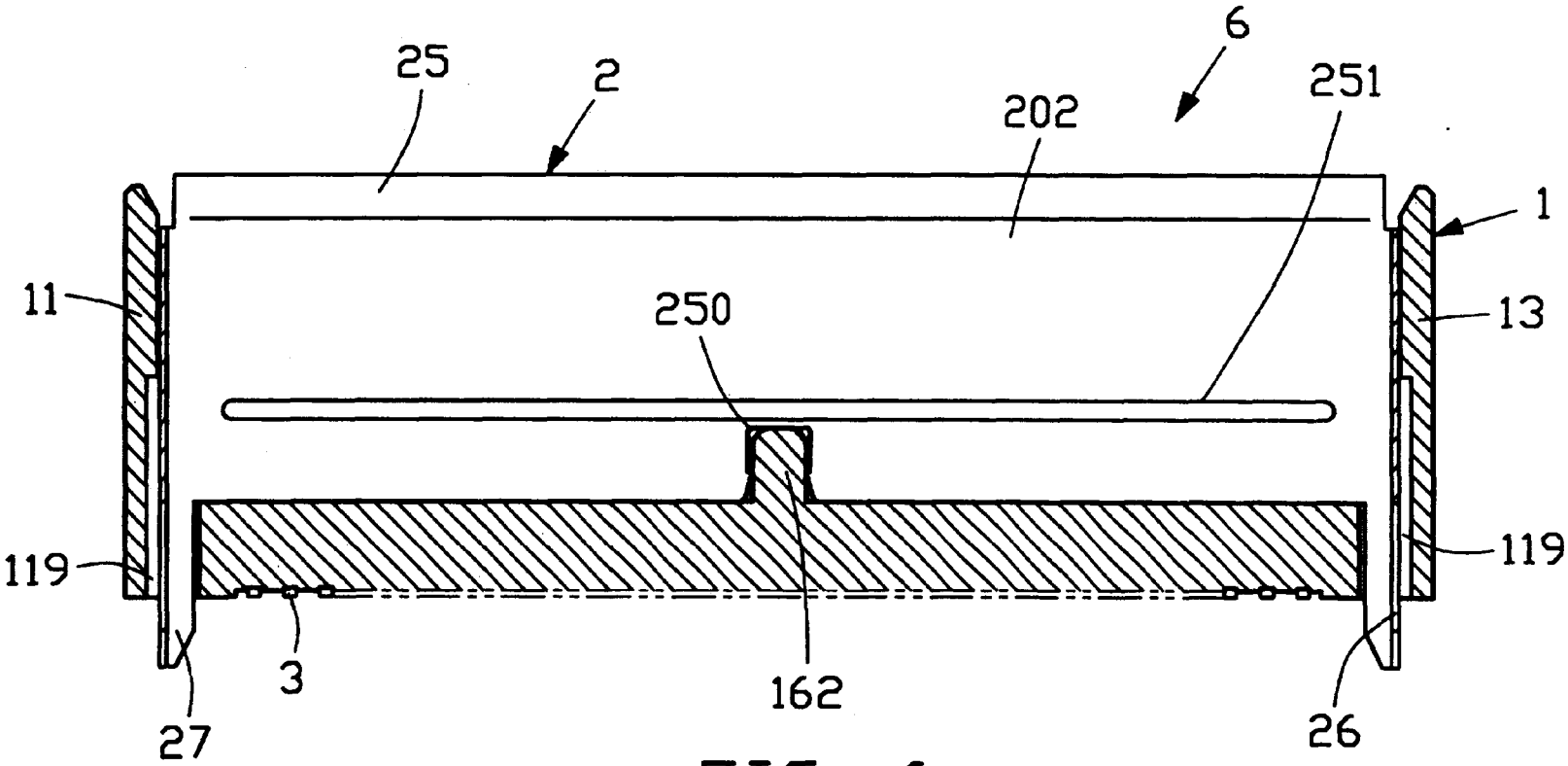
FIG. 6 is a cross-sectional view taken along line VI—VI of FIG. 2.

Preferably the shielding member 2 is formed by stamping a metal sheet and has a U-shaped configuration having a central section 202 and two side sections 201, 203 substantially corresponding to and supported by inside surfaces of the corresponding sections 11, 13, 15 of the shroud wall. Each section 201, 202, 203 of the shielding member 2 has an outwardly bent flange 21, 23, 25 formed on a top edge thereof for guiding the insertion of the mating socket 4 into the space 19 and electrically engaging with a grounding member of the mating connector 4 for electrostatic discharge purposes. The shielding member 2 has two rear securing legs 26, 27 and two front securing legs 28, 29 extending through corresponding holes 119 defined in the housing 1 and beyond the second face 14 thereof (FIG. 6) for mounting to a circuit board (not shown). A through hole 280, 290 is defined through each front securing leg 28, 29 for allowing molten solder material to flow therethrough thereby more securely fixing the connector 6 to the circuit board. The rear securing legs 26, 27 are formed with an L-shaped cross section and tapered ends for facilitating insertion into holes defined in the circuit board and achieving better soldering results.

Figure 5:
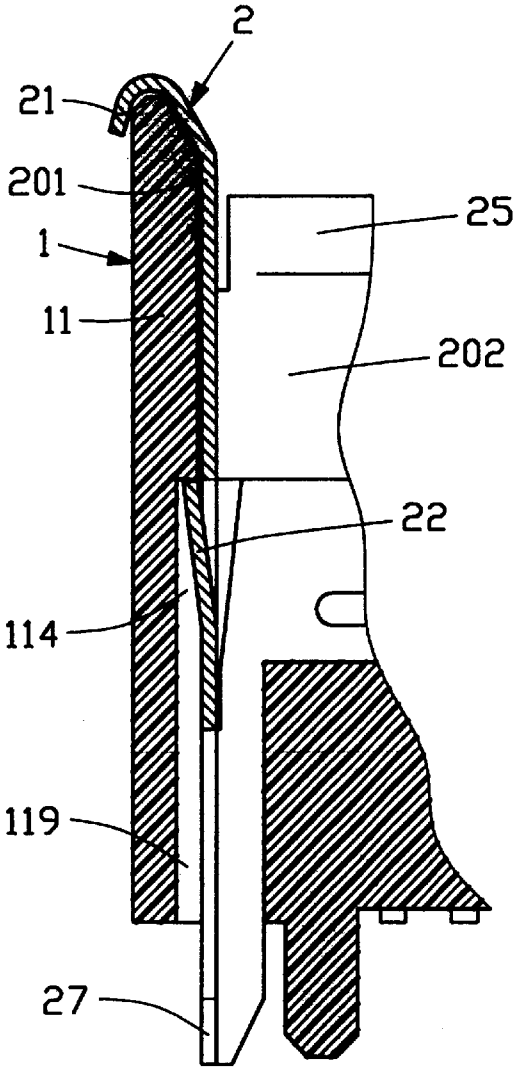
FIG. 5 is a cross-sectional view taken along line V—V of FIG. 2.

Retaining means is provided to securely retain the shielding member 2 in the space 19 of the housing 1. The retaining means comprises outward projections 22, 24 formed on the side sections 201, 203 of the shielding member 2. The projections 22, 24 engage with recesses 114 defined in the inner surfaces of the lateral sections 11, 13 of the shroud wall (FIG. 5). The retaining means further comprises a notch 250 defined in a lower edge of the central section 202 of the shielding member 2 for receivingly engaging with a projection 162 (FIG. 6) formed on the housing 1. Preferably, the notch 250 has barbs 252 extending therein for more securely engaging with the projection 162.

An elongate rib 251 is formed on the shielding member 2 for providing a more secure mechanical engagement with the plug connector 4 and a better electrical engagement therebetween.

It should be understood that according to FIGS. 7 and 8, guiding wall 17 should be invade the mating socket connector 4 and substantially positioned between the main portion of the socket connector 4 and the circuit board 5. In other words, the shroud wall including the longitudinal section 15, the pair of lateral sections 11, 13 cooperating with the guiding wall 17, may enclose the socket connector 4. It is also noted that the shielding member 2 includes the central section 202 and two side sections 201, 203 substantially corresponding to the sections 11, 13, 15 of the shroud wall, while providing an opening facing to the guide wall 17 so as not to interfere with the projection portions 42 of the socket connector 4 and the circuit board 5 thereunder.

Although the present invention has been described with reference to the preferred embodiment, it is apparent to those skilled in the art that a variety of modifications and changes may be made without departing from the scope of the present invention which is intended to be defined by the appended claims.

What is claimed is:

1. An electrical connector comprising;

an insulative housing having a first face and an opposite second face and a plurality of passageways defined therebetween for retaining contact elements therin, each contact element having ends respectively extending beyond the first and second faces, a shroud wall having a longitudinal section and a pair of lateral sections extending from upper opposite sides thereof, and a guide wall being formed on the first face defining a space, between said guide wall and said shroud wall, adapted to receive a mating connector, the shroud wall and the guide wall having inclined inside faces diverging away from each other for facilitating insertion of a mating connector into the space; and a shielding member received in the space and supported by the shroud wall for electrically engaging with a grounding member of the mating connector, the shielding member having a lower edge received in a slot defined in the first face of the housing, a notch including barbs extending therein and being defined in the lower edge of the shielding member for receiving a projection formed on the housing to secure the shielding member to the housing.

2. The electrical connector as claimed in claim 1, wherein the guide wall has opposite inclined lateral edges for guiding the mating connector.

3. The electrical connector as claimed in claim 1, wherein barbs extend into the notch for securely engaging with the projection.

4. The electrical connector as claimed in claim 1, wherein outward projections are formed on the shielding member for engaging with recesses defined in the housing thereby securing the shielding member to the housing.

5. The electrical connector as claimed in claim 1, wherein an outwardly bent flange is formed on a top edge of the shielding member for guiding the insertion of the mating connector into the space and electrically engaging with the grounding member of the mating connector.

6. The electrical connector as claimed in claim 1, wherein the mating connector is mounted to a circuit board, and wherein the shroud wall has at least one inclined edge for guiding a relative motion of the electrical connector with respect to the circuit board.

7. The electrical connector as claimed in claim 1, wherein a tongue plate is formed on the first face of the housing extending into the space and surrounded by the longitudinal and lateral sections of the shroud wall and the guide wall, and wherein the passageways are further defined by grooves formed on surfaces of the tongue plate for receiving ends of the contact elements therein.

8. The electrical connector as claimed in claim 1, wherein the shielding member comprises an elongate rib formed thereon for more securely engaging with the grounding member of the mating connector.

9. An electrical connector comprising an insulative housing having first and second walls formed on a first face thereof, the first wall comprising a longitudinal section and two opposite lateral sections which, together with the second wall, define a space therebetween adapted to receive a mating connector, a plurality of passageways being defined in the housing for receiving and retaining contact elements therein and means for shielding the contact elements and electrically engaging with a grounding member of the mating connector, a shielding means comprising a central panel and two side panels received in the space and respectively supported by the longitudinal and lateral sections of the first wall; and each of said two side panels having a securing leg and a lower edge of said central panel having a notch including a barb for securing the shielding means to the housing.

10. The electrical connector as claimed in claim 9, wherein the mating connector being mounted on a circuit board, at least one of the lateral sections having an inclined edge serving as a camming surface for guiding a relative movement of the circuit board with respect to the housing.

11. The electrical connector as claimed in claim 10, wherein the lateral sections of the first wall comprise inclined edges opposite each other for guiding the relative movement of the circuit board with respect to the housing.

12. An electrical connector adapted to mate with a complementary connector mounted on a circuit board, said connector comprising an insulative housing defining a shroud wall for receiving said complementary connector therein, said shroud including a longitudinal section and a pair of lateral sections extending from opposite sides thereof, a guide wall extending opposite to said longitudinal section with two notches by two sides thereof, a tongue plate extending in said shroud wall, a shielding member defining a U-shape configuration including a central section and two side sections respectively positioned inside said longitudinal section and said pair of lateral sections, each of said two side sections having a securing leg and a lower edge of said central section having a notch including a barb for securing the shielding member to the housing.

13. An connector assembly comprising:

a first connector including an insulative housing having a first face on which a shroud wall is formed, said shroud wall including a longitudinal section and two side sections extending from two sides thereof;

a guide wall formed on the first face and opposite to said longitudinal section;

a second connector mounted on a circuit board;

a tongue plate extending from the first face and surrounded by the shroud wall and the guide wall with passageways defined therein for receiving and retaining contact elements;

said shroud wall cooperates with said guide wall for enclosing a main body of the second connector therein under the condition that the guide wall is sandwiched between the main body of the second connector and the circuit board; wherein said first connector further includes a shielding means comprising a central panel and two side panels respectively supported by the longitudinal and lateral sections of the shroud wall, each of said two side panels having a securing leg and a lower edge of said central panel having a notch including a barb for securing the shielding means to the housing.

* * * * *